United States Patent [19]

Cavalieri d'Oro

[11] Patent Number: 4,471,329

[45] Date of Patent: Sep. 11, 1984

[54] MICROWAVE CIRCUIT COMPONENT FOR SUPERHIGH-FREQUENCY SIGNALS

[75] Inventor: Enzo Cavalieri d'Oro, Monza, Italy

[73] Assignee: Italtel Societa Italiana Telecomunicazioni S.p.A., Milan, Italy

[21] Appl. No.: 354,606

[22] Filed: Mar. 4, 1982

[30] Foreign Application Priority Data

Mar. 5, 1981 [IT] Italy ..... 20138 A/81

[51] Int. Cl.[3] ..... H01P 1/387; H01P 5/22; H01P 5/18

[52] U.S. Cl. ..... 333/1.1; 333/246; 333/120; 333/116

[58] Field of Search ..... 333/238, 116, 246, 1.1, 333/224, 226, 205, 204, 120, 161, 263

[56] References Cited

U.S. PATENT DOCUMENTS

| | | | |
|---|---|---|---|
| 2,926,317 | 2/1960 | Blitz | 333/238 |
| 3,020,500 | 2/1962 | Beiser | 333/226 |
| 3,496,492 | 2/1970 | Kurzl et al. | 333/116 |
| 3,513,413 | 5/1970 | Nakahara et al. | 333/1.1 |
| 3,716,805 | 2/1973 | Knerr | 333/1.1 |
| 3,925,740 | 12/1975 | Steensma | 333/226 X |
| 4,316,160 | 2/1982 | Dydyk | 333/120 |

*Primary Examiner*—Paul L. Gensler
*Assistant Examiner*—Benny Lee
*Attorney, Agent, or Firm*—Karl F. Ross; Herbert Dubno

[57] ABSTRACT

A circuit component for use with signals of superhigh frequency, on the order of 10 GHz or more, has a waveguide structure with four conductive walls defining a channel of rectangular cross-section, the channel bottom being overlain by a dielectric layer supporting at least one microstrip of copper or the like closely spaced from one of the lateral walls. The supporting layer preferably consists of a polymeric material of relatively low dielectric constant, e.g. between 2 and 3. The width and height of the channel are less than half the free-space wavelength of the highest-frequency signal to be transmitted; the circuit is tuned by metallic screws which are threaded into the adjoining wall and partly overlie the microstrip at a low level, the axes of adjacent screws being separated by less than an eighth of that wavelength.

14 Claims, 5 Drawing Figures

MICROWAVE CIRCUIT COMPONENT FOR SUPERHIGH-FREQUENCY SIGNALS

FIELD OF THE INVENTION

My present invention relates to a component of a microwave circuit designed for the transmission of signals of very elevated frequency, particularly those in the superhigh-frequency (SHF) range on the order of 10 GHz or more.

BACKGROUND OF THE INVENTION

For the transmission of microwaves it is known to use components in which a dielectric substrate has a metallized lower surface, referred to as a ground plane, and supports on its upper surface one or more microstrips of copper or other highly conductive metal. When a high-frequency signal is applied between the microstrip and the ground plane, the resulting electromagnetic field is carried mainly in the dielectric substrate but is also partly radiated outward so as to cause possible interferences with other equipment. The intensity of this interfering radiation increases progressively with frequency. The wavelength of the signal in the substrate equals its free-space wavelength divided by the square root of the dielectric constant ($\epsilon$) and thus varies inversely with that constant. For a given signal frequency, therefore, conductor sections tied to wavelength (e.g. quarter-wave or half-wave sections) will have to be shorter with increasing dielectric constant. This creates structural problems in the realization of microstrip components for superhigh frequencies.

Dielectric materials commonly used for the substrate of microstrip circuits include alumina ($\epsilon \approx 10$) and certain plastics. A polymeric material of relatively low dielectric constant ($\epsilon \approx 2.3$) is glass-fiber-reinforced Teflon available under the name Duroid from the Rogers Company, Chandler, Ariz. At a given frequency, the proportion of electromagnetic energy radiated outward increases with lower dielectric constants; thus, if the level of emitted radiation is a criterion, a conventional microstrip circuit using an alumina substrate can be operated at a higher maximum frequency than one whose substrate consists of a plastic material of relatively low dielectric constant. From the structural viewpoint referred to, on the other hand, polymeric materials with dielectric constants between about 2 and 3 are more desirable.

For the foregoing reasons it has heretofore been difficult to design microstrip components for operation at frequencies higher than about 10 GHz. With such high frequencies there is also the problem of proper tuning to establish or maintain the necessary circuit characteristics such as resonant frequency, line impedance and equivalent length, or to correct unavoidable irregularities. The conventional technique involves the placing of conductive blobs on the substrate or on the microstrip; such a procedure is not very convenient and does not enable continuous adjustment or elimination of overcorrections.

OBJECTS OF THE INVENTION

The general object of my present invention, accordingly, is to provide an improved circuit component of the character described which can be operated at very elevated frequencies with avoidance of the aforestated drawbacks.

A more particular object is to provide such a component with simple and effective tuning means enabling continuous adjustment of circuit parameters.

SUMMARY OF THE INVENTION

A circuit component according to my present invention comprises a metallic base with a pair of parallel metallic walls rising therefrom and defining between them a channel whose width is less than half the free-space wavelength of a superhigh-frequency signal to be transmitted. A dielectric substrate overlying the base within the channel supports at least one microstrip of highly conductive metal whose width is a small fraction of the channel width and which lies close to one of the walls. This wall has a plurality of transverse bores into which respective tuning screws are threaded at a level slightly above the microstrip which is overhung to an adjustable extent by the projecting extremities of the screws.

The metallic lateral walls rising above the substrate act as shields serving to protect external equipment from radiated microwave energy. The shielding effect can be enhanced by the provision of a metallic top spanning these walls and closing the channel from above. With the height of the channel between the dielectric bottom layer or substrate and the metallic top plate also less than half the aforementioned free-space wavelength, the component has the structure of a rectangular waveguide whose cutoff frequency is higher than that of the transmitted signal which therefore cannot be propagated in the free space of the channel. The metallic base underlying the substrate takes the place of the usual ground plane.

It will be understood that terms such as "top" and "bottom" are used here only in a relative sense and that the structure can have any desired orientation.

The tuning screws overhanging a particular microstrip should be relatively closely spaced, with the axes of adjacent screws preferably separated by less than an eighth of the substrate wavelength of the transmitted signal, in order to provide the necessary continuity of the signal path. Since the substrate wavelength varies generally inversely with the dielectric constant, as noted above, the substrate is advantageously made of a polymeric material with $\epsilon \leqq 3$, such as the reinforced Teflon referred to above.

The substrate may support several conductors in the form of substantially identical microstrips, each of these strip conductors lying close to one of the lateral channel walls and being overhung by a respective array of tuning screws. These strip conductors may be interconnected within the channel by a circular foil portion, in the form of a disk or a ring, which may be underlain by a core of ferrimagnetic material such as ferrite in order to enable a directional control of signal transmission between the conductors by an externally applied magnetic field. Such a conductor system can be designed as a circulator or as a duplexer.

BRIEF DESCRIPTION OF THE DRAWING

The above and other features of my invention will now be described in detail with reference to the accompanying drawing in which.

SPECIFIC DESCRIPTION

Figure 1:
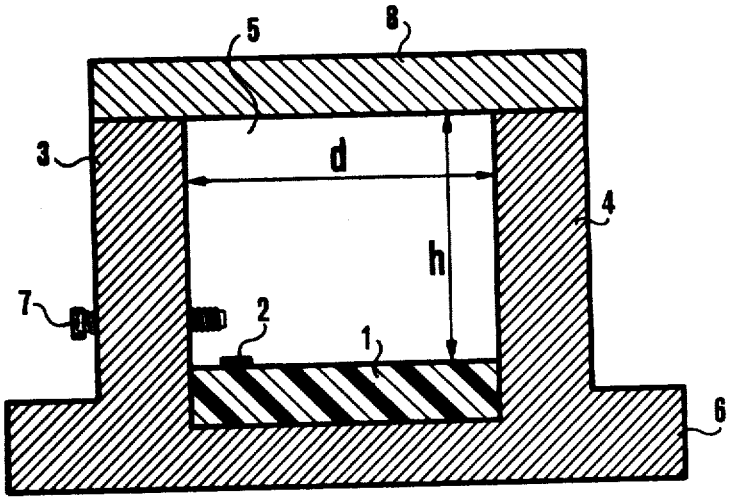
FIG. 1 is a cross-sectional view of a circuit component embodying my invention, taken on the line I—I of FIG. 2.
Figure 2:
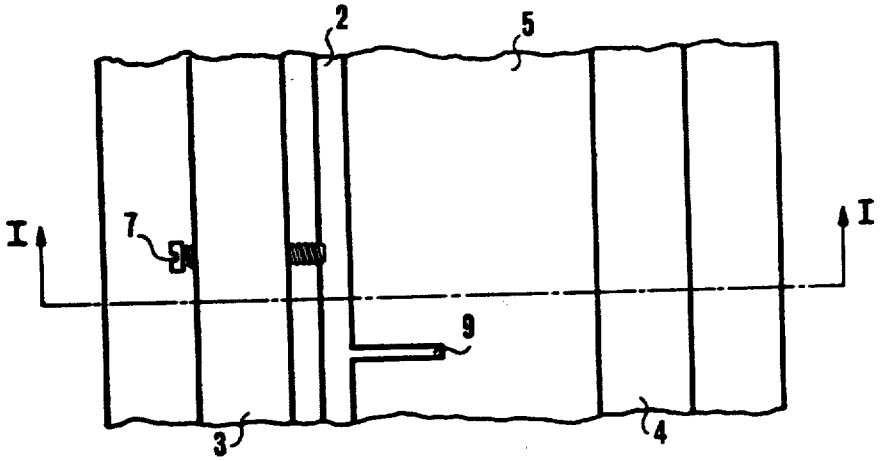
FIG. 2 is a fragmentary plan view of the component of FIG. 1 with its top plate removed.

FIGS. 1 and 2 show a substrate 1 formed by a layer of dielectric material, preferably Duroid, on the bottom of a channel 5 of rectangular cross-section. The channel is bounded by a metallic housing of generally U-shaped profile, comprising a base 6 integral with two lateral walls 3 and 4, and by a metallic top plate 8 spanning these walls. The width d and the height h of channel 5 (the latter being measured from the upper substrate surface) are both less than half a free-space wavelength of a superhigh-frequency signal applied between the grounded housing and a longitudinally extending microstrip 2 supported on the substrate 1 in the immediate vicinity of wall 3; microstrip 2 has a width which is a small fraction of channel width d and approximately equals its distance from the adjoining wall. A metallic screw 7, threaded into a transverse bore of wall 3, partly overhangs the strip 2 and can be adjusted for capacitively tuning the circuit formed by this strip and the base 6; the distance of screw 7 above strip 2 is a small fraction of height h and may be roughly equal to the spacing of the strip from wall 3. Screw 7 is one of several such screws disposed on the same level above the microstrip 2 (cf. FIGS. 3 and 4) with center-to-center spacings of less than one-eighth the substrate wavelength of the applied signal. The ends of channel 5 could be closed by nonillustrated metal plates.

As shown in FIG. 2, microstrip 2 may have one or more lateral spurs 9 enabling its connection to an input or output electrode of an active semiconductor element which has also not been illustrated.

Figure 3:
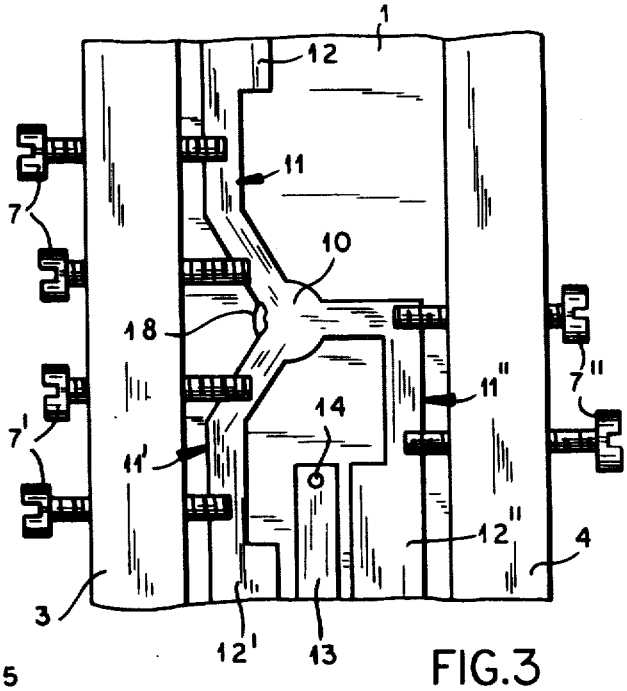
FIG. 3 is a fragmentary plan view, similar to that of FIG. 2, illustrating the use of a circuit component according to my invention designed as a circulator.

FIG. 3 depicts the substrate 1 and the lateral walls 3, 4 of a component similar to that illustrated in FIGS. 1 and 2, the substrate in this instance supporting three microstrips 11, 11', 11" which are conductively interconnected by a disk-shaped foil portion 10 of the same metallic material and preferably the same thickness. Each microstrip has a terminal portion 12, 12', 12" of relatively large width and therefore low line impedance, e.g. of about 50 ohms, serving as an input or output port connected to a signal source or to a load. Each terminal portion parallels and lies close to one of the lateral walls, as does an adjoining half of a substantially narrower strip section of significantly higher impedance whose other half includes an obtuse angle therewith and merges into the disk 10 at a respective junction point; the three junction points are angularly staggered by 120°. The narrower, high-impedance section of each microstrip has a length equal to half the substrate wavelength of the applied signal; its two angularly adjoining subsections, of a quarter wavelength each, may also be of different width with the narrower one terminating at disk 10 in a manner similar to that described hereinafter with reference to FIG. 5.

Disk 10, shown partly broken away, is coaxially underlain by a ferrite core 18 in the form of a thin disk of like diameter embedded in the substrate 1. A transverse magnetic field applied in the direction of the disk axis, by a nonillustrated yoke with a winding traversed by direct current of reversible polarity, enables the direction of signal transmission to be controlled; with a given polarity of magnetization, signals may pass in, say, a clockwise sense from one disk junction to the next.

Also supported on the dielectric layer 1 in FIG. 3 is a metallic track 13, similar in structure to the several microstrips, which is conductively connected to the grounded base 6 (FIG. 1) by a hole 14 with metallized peripheral surface and is insulatedly interposed between the parallel portions of strips 11' and 11" for shielding them from each other. Track 13 is also grounded at other locations by metallized holes similar to that shown at 14, all these holes being spaced apart by less than a quarter of the substrate wavelength.

As in the preceding embodiment, microstrips 11, 11' and 11" are spacedly overhung by respective sets of tuning screws 7, 7', and 7" all lying on the same level. As before, adjacent screws ought to have a center-to-center spacing of less than an eighth of the substrate wavelength; this requires a rather large number of such screws per strip though for simplicity's sake only two have been shown in each instance.

The optimum thickness of the ferrimagnetic core 18 varies inversely with frequency and in the range above 10 GHz would have to be extremely small if the high-impedance strip sections of half a wavelength, separating the disk 10 from the terminal portions 12, 12' and 12", were replaced by quarter-wave-length sections of relatively low impedance as is the case with conventional circulators. The disclosed arrangement allows for the use of a less fragile ferrite disk 18, with a thickness equal to a significant fraction of a millimeter, at the frequencies here contemplated. An even more advantageous arrangement is a replacement of each of these high-impedance strip sections by two quarter-wavelength subsections in series, the one proximal to the disk 10 being narrower than the other, substantially as shown for a different embodiment in FIG. 5. With this progressive adaptation of the line impedance of each half-wavelength section to that of the ferrite disk, the latter may be given a thickness equal to that of the layer 1 in which it is embedded, thereby simplifying its insertion into that layer.

Figure 4:
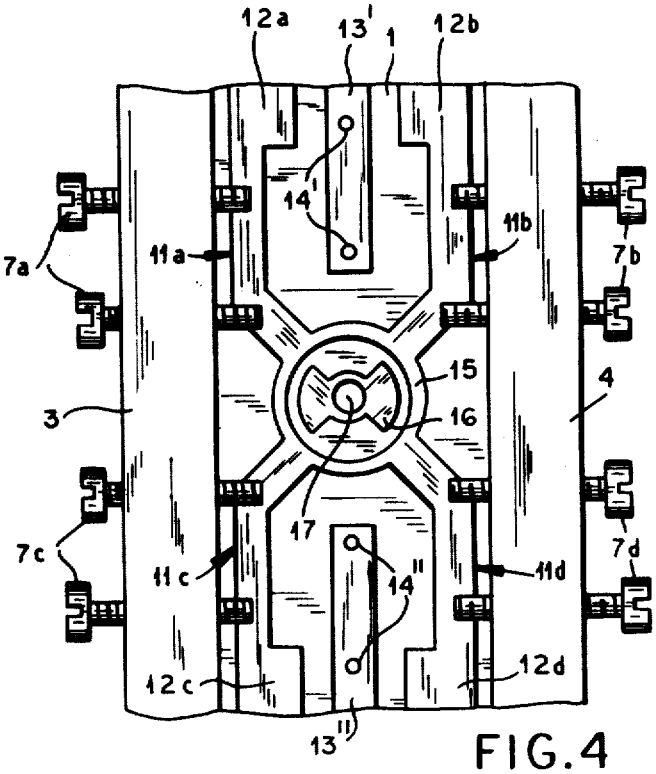
FIG. 4 is a view similar to that of FIG. 3, illustrating a circuit component designed as a duplexer or directional coupler.

In FIG. 4 I have shown a conductor array similar to that of FIG. 3, with two pairs of microstrips 11*a*, 11*b* and 11*c*, 11*d* having high-impedance half-wavelength sections extending between respective terminal portions 12*a*, 12*b*, 12*c*, 12*d* and a central conductive ring 15 of constant width, integral with the strips, whose median circumference equals a substrate wavelength. The junctions formed between ring 15 and strips 11*a*–11*d* are spaced 90° apart, being thus interconnected by quadrantal ring segments. The diametrically opposite segments bridging strips 11*a*, 11*b* and 11*c*, 11*d* are of relatively high impedance; the two remaining segments, while being of the same width as the other two, have their impedance significantly lowered (but still well above that of the terminal portions) by the proximity of respective extremities of a butterfly-shaped conductive patch 16 made from the same kind of foil as the ring and the microstrips. The dimensions are so chosen that the impedances of the transverse segments interlinking the strips of each pair bear a ratio of $\sqrt{2}$:1 to the impedances of the longitudinal segments respectively connecting strips 11*a* and 11*b* to strips 11*c* and 11*d*. Patch 16 is grounded by a metallized peripheral surface of a hole 17 extending through the substrate to the underlying metallic base; similarly metallized holes 14' and 14", again spaced apart by less than a quarter of the substrate wavelength, ground two centrally positioned tracks 13' and 13'' inserted between the parallel sections of the two microstrip pairs.

Figure 5:
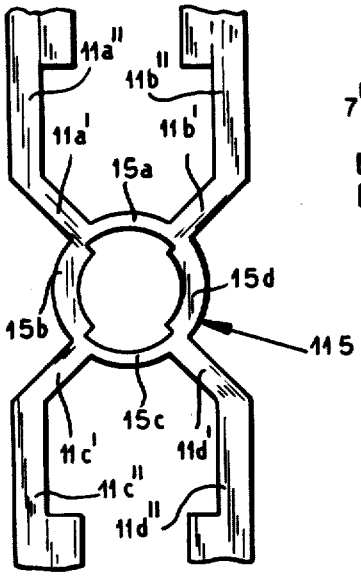
FIG. 5 is a partial plan view of a conductor array for a modification of the duplexer of FIG. 4.

As in the embodiment of FIG. 3, each half-wavelength microstrip section can be capacitively tuned by a respective set of overhanging screws *7a, 7b, 7c* and *7d* threaded into walls 3 and 4. Again, these microstrip sections may each be subdivided into a wider subsection 11a''-11d'' proximal to the corresponding terminal portion and a narrower subsection 11a'-11d' proximal to the central ring, as indicated in FIG. 5, with each section again measuring a quarter wavelength and having a line impedance considerably higher than that of the terminal portions. FIG. 5 further illustrates a modified ring 115 which, in a manner known per se, has relatively narrow transverse segments 15a, 15c and relatively wide longitudinal segments 15b, 15d with an impedance ratio of $\sqrt{2}$:1 as noted above. This eliminates the need for the central patch 16 but makes operation at higher frequencies more difficult since a reduction in ring diameter could bring the two longitudinal segments 15b and 15d close to each other.

With a ferrite disk such as that shown in FIG. 3 again disposed underneath the ring 15 or 115, the structure of FIG. 4 or FIG. 5 can be used as a directional coupler enabling the transmission of microwave energy, for example, between a transceiver connected across terminal portions 12a, 12b and an antenna connected across termainal portions 12c and 12d, with alternation between a transmitting and a receiving phase by periodic reversals of the polarity of the applied magnetic field. Where directivity is not required, the ferrite disk and the magnetic-field source may of course be omitted.

I claim:

1. A circuit component for the transmission of signals of very elevated frequency, comprising:

a metallic base;

a pair of parallel metallic walls rising from said base and defining between them a channel of a width less than half the free-spacing wavelength of a superhigh-frequency signal to be transmitted;

a dielectric substrate in said channel overlying said base;

four substantially identical microstrip conductors, whose width is a small fraction of the channel width, supported on said substrate and conductively interconnected by a ring underlain by a ferrimagnetic core in said substrate enabling a directional control of signal transmission between said strip conductors by an externally applied magnetic field, said ring having a median circumference equal to the substrate wavelength of said superhigh-frequency signal and forming junctions with said microstrip conductors at locations spaced 90° apart; and a metallic patch conductively connected to said base, said patch being situated inside said ring and closely approaching diametrically opposite quandrantal segments thereof disposed between respective pairs of said junctions.

2. A circuit component for the transmission of signals of very elevated frequency, comprising:

a metallic base;

a pair of parallel metallic walls rising from said base and defining between them a channel of a width less than half the free-space wavelength of a superhigh-frequency signal to be transmitted;

a dielectric substrate in said channel overlying said base; and a plurality of substantially identical microstrip conductors of highly conductive metal, whose width is a small fraction of the channel width, supported on said substrate close to said walls, said microstrip conductors being interconnected by a circular foil portion underlain by a ferrimagnetic disk of substantially the same diameter embedded in said substrate for enabling a directional control of signal transmission between said microstrip conductors by an externally applied magnetic field, said microstrip conductors having relatively wide low-impedance terminal portions separated from said circular foil portion by narrower strip sections of higher impedance whose length above said substrate equals half the substrate wavelength of said superhigh-frequency signal.

3. A circuit component as defined in claim 2, further comprising a metallic top spanning said walls and closing said channel from above, the height of said channel between said substrate and said top being less than half said free-space wavelength.

4. A circuit component as defined in claim 2 wherein said circular foil portion is a closed ring with a median circumference equal to the substrate wavelength of said superhigh-frequency signal, said ring forming junctions with four of said microstrip conductors at locations spaced 90° apart.

5. A circuit component as defined in claim 4 wherein said junctions are interconnected by alternately wider and narrower continuous quadrantal segments of said ring.

6. A circuit component as defined in claim 4 wherein a metallic patch conductively connected to said base is disposed inside said ring and closely approaches diametrically opposite quadrantal segments thereof disposed between respective pairs of said junctions.

7. A circuit component as defined in claim 2 wherein said circular foil portion is a disk forming junctions with three of said strip conductors at locations spaced 120° apart.

8. A circuit component as defined in claim 2 wherein said narrower strip sections are each divided into two quarter-wavelength subsections, the subsections adjoining said terminal portions being of greater width than those adjoining said circular foil portion.

9. A circuit component as defined in claim 2 wherein an ancillary microstrip conductively connected to said base lies between two of said strip conductors extending along opposite sides of said channel.

10. A circuit component as defined in claim 2 wherein said disk has a thickness equaling that of said substrate.

11. A circuit component as defined in claim 2 wherein, with a signal frequency of at least 10 GHz, said substrate consists of glass-fiber-reinforced Teflon with a dielectric constant of about 2.3.

12. A circuit component as defined in claim 2, 3, 4, 8 or 11, further comprising a plurality of tuning screws threaded into respective transverse bores of said walls at a level slightly above said microstrip conductors, said screws overhanging said microstrip conductors to an adjustable extent.

13. A circuit component as defined in claim 12 wherein the spacing of said microstrip from said level is a small fraction of the channel height.

14. A circuit component as defined in claim 12 wherein said screws have axes spaced apart by less than an eighth of the substrate wavelength of said superhigh-frequency signal.

* * * * *